US005826598A

United States Patent [19]

Meehan

[11] Patent Number: 5,826,598

[45] Date of Patent: Oct. 27, 1998

[54] SCENTED HAIR ACCESSORY

[76] Inventor: Katharine E. Meehan, 18 Obtuse Rd., Newtown, Conn. 06470

[21] Appl. No.: 892,850

[22] Filed: Jul. 15, 1997

Related U.S. Application Data

[63] Continuation of Ser. No. 529,659, Sep. 18, 1995, abandoned.

[51] Int. Cl.[6] ..... A45D 8/12

[52] U.S. Cl. ..... 132/275; 132/273; 2/174

[58] Field of Search ..... 132/212, 273, 132/275; 63/1.1, 2, 3, 12, 11, 13, 6, 7, 8, 14.1, 14.4; D28/39, 41; 2/174

[56] References Cited

U.S. PATENT DOCUMENTS

| | | | |
|---|---|---|---|
| D. 292,030 | 9/1987 | Revson . | |
| D. 315,226 | 3/1991 | Revson . | |
| 1,864,199 | 6/1932 | Kahn . | |
| 2,234,062 | 3/1941 | Roberts . | |
| 2,560,681 | 7/1951 | Berkowitz . | |
| 2,749,920 | 6/1956 | Kriesman et al. . | |
| 4,744,514 | 5/1988 | Gadoua | 239/36 |
| 4,785,642 | 11/1988 | Chin et al. . | |
| 4,972,684 | 11/1990 | Aitken . | |
| 5,031,419 | 7/1991 | Gelman . | |
| 5,156,171 | 10/1992 | Goodman | 132/275 |
| 5,217,143 | 6/1993 | Aitken . | |
| 5,413,126 | 5/1995 | Revson | 132/275 |
| 5,456,274 | 10/1995 | Selbee et al. | 132/275 |
| 5,497,795 | 3/1996 | Hibbard | 132/275 |

*Primary Examiner*—Gene Mancene
*Assistant Examiner*—Pedro Philogene
*Attorney, Agent, or Firm*—Clifford L. Tager

[57] ABSTRACT

The present invention is directed to a scented hair accessory preferably comprising a substantially tubular housing having a first and a second terminal end joined together to define an inner circumferential area. The tubular housing is substantially flexible and resiliently expandable about the inner circumferential area. A chamber is located within the tubular housing, into which a scenting material is located. At least a portion of the tubular housing is porous, thereby allowing the scent emanating from the scented material to escape therefrom. Optionally, a pocket is attached to the tubular housing, and the scenting material is located therewithin. The pocket is preferably sealably accessible, thereby allowing a user to remove and/or replace the scenting material therefrom. An elastic material is preferably located within the chamber to allow the tubular housing to be resiliently expandable about the inner circumferential area. Alternatively, the tubular housing can comprise an elastic material. In another embodiment of the present invention, an ornamental structure is located about a portion of the tubular housing. Optionally, scenting is operatively located on the ornamental structure. The scented hair accessory can be worn either in the hair, functionally to secure the hair in a pony tail arrangement or decoratively to provide a scent thereat, on the wrist, about the neck or at the ankle in a decorative manner.

15 Claims, 2 Drawing Sheets

SCENTED HAIR ACCESSORY

This application is a continuation of application Ser. No. 08/529,659, filed 18 Sep. 1995, now abandoned.

BACKGROUND OF THE INVENTION

Technical Field

The present invention is directed to an accessory. More particularly, the present invention is directed to a scented accessory which can be worn either in the hair, functionally to secure the hair in a pony tail arrangement or decoratively to provide a scent thereat, on the wrist, about the neck or at the ankle in a decorative manner.

SUMMARY OF THE INVENTION

A first embodiment of the present invention is directed to a scented hair accessory preferably comprises a substantially tubular housing having a first and a second terminal end joined together to define an inner circumferential area. The tubular housing is preferably substantially flexible and resiliently expandable about the inner circumferential area.

A chamber is preferably located within the tubular housing, into which a scenting material is located. At least a portion of the tubular housing is preferably porous, thereby allowing the scent emanating from the scented material to escape therefrom.

An elastic material is preferably located within the chamber to allow the tubular housing to be resiliently expandable about the inner circumferential area. Alternatively, the tubular housing can comprise an elastic material.

Optionally, a pocket is attached to the tubular housing, and the scenting material is located therewithin. At least a portion of the pocket is preferably porous, thereby allowing the scent emanating from the scented material to escape therefrom.

The pocket preferably comprises an enclosed portion and an open portion, and the tubular housing further comprises a slit therein. At least a section of the enclosed portion of the pocket is located within the chamber of the tubular housing, and at least a section of the open portion of the pocket is attached to the tubular housing.

The open portion of the pocket is preferably sealably accessible, thereby allowing a user to remove and/or replace the scenting material.

In another embodiment of the present invention, an ornamental structure is located about a portion of the tubular housing. Optionally, scenting is operatively located on the ornamental structure.

The scented hair accessory can be worn either in the hair, functionally to secure the hair in a pony tail arrangement or decoratively to provide a scent thereat, on the wrist, about the neck or at the ankle in a decorative manner.

DESCRIPTION OF THE PREFERRED EMBODIMENT(S)

Figure 1:
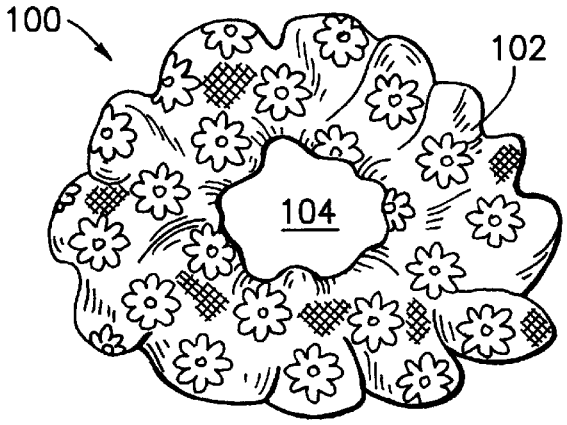
FIG. 1 is a top view of a preferred embodiment of the scented hair accessory of the present invention.

Turning now to FIG. 1, a preferred embodiment of the scented hair accessory of the present invention is illustrated. Scented hair accessory 100 preferably comprises substantially tubular housing 102, at least a portion of which comprises a chamber into which scenting material (not shown) is located.

At least a portion of tubular housing 102 is preferably porous, thereby allowing the scent emanating from the scented material located within the tubular housing to escape therefrom. The surface of the tubular housing can optionally include a pattern thereon for decorative purposes.

The tubular housing forms inner circumferential area 104, and the tubular housing is preferably resiliently expandable thereabout. In this way, the scented hair accessory can be worn in a user's hair to secure the hair in a pony tail arrangement or as a decorative accessory to simply provide a scent.

While the present invention illustrated by FIG. 1 is discussed herein as a "scented hair accessory", it should be understood that the present invention can be used as a scented accessory in other ways. For example, the scented hair accessory can be worn on a user's wrist, about the neck or at the ankle. Additionally, the present invention can be used to wrap a gift box, thereby functioning both as a ribbon until the gift box is opened, and as a scented hair accessory thereafter. Other locations and/or uses will be obvious to one skilled in the art.

With reference to FIGS. 2 through 5, a preferred method of making the embodiment of the scented hair accessory illustrated in FIG. 1 is discussed.

Figure 2:
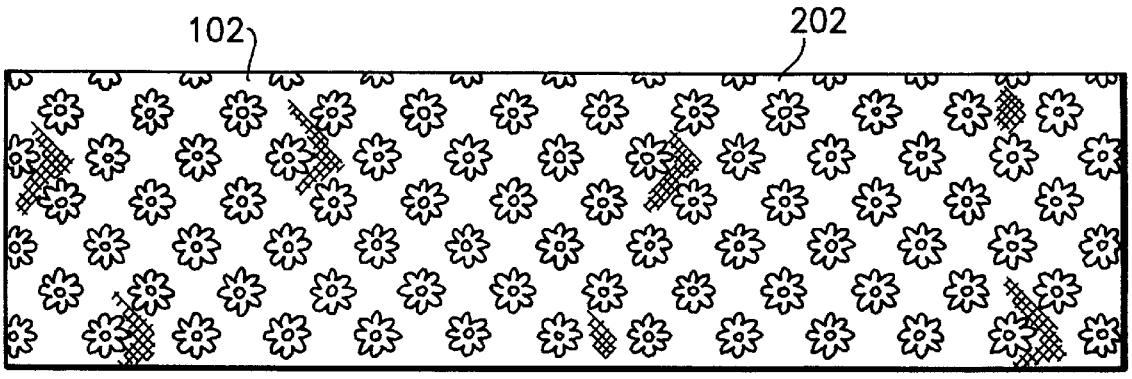
FIGS. 2 through 5 depicts a preferred method of making the preferred embodiment of the present invention illustrated in FIG. 1.

FIG. 2 illustrates a front view of the material used to form tubular housing 102. In the preferred embodiment, material 202 used to form the tubular housing is a porous fabric, e.g., a 200-thread count cotton and polyester blend cloth having a pattern at least on one side thereof. Alternatively, the tubular housing can be formed from crocheted or knitted material. Other fabric types will be obvious to those skilled in the art.

When intended for use primarily in the user's hair, the dimensions of the fabric used to form the tubular housing is preferably twenty (20) inches in length and five (5) inches in width. Other lengths and/or widths will be obvious to those skilled in the art.

Figure 3:
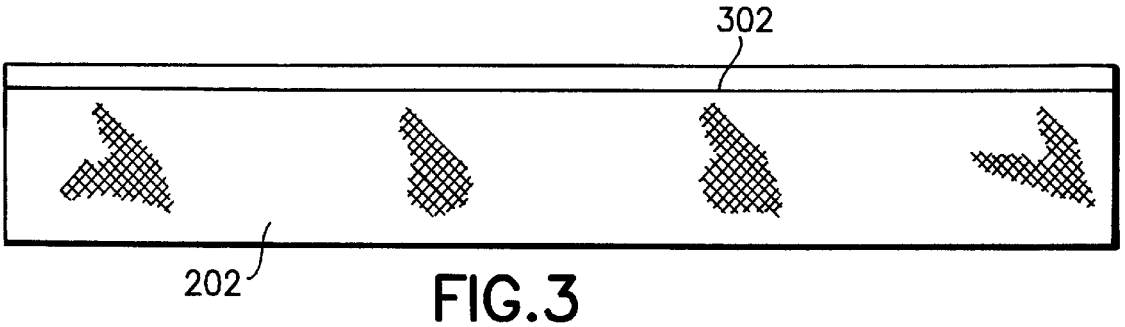

With reference to FIG. 3, the tubular housing is preferably constructed by folding material 202 along its longitudinal axis, and securing the longitudinally terminal ends thereof together, as shown by reference 302. Material 202 can be secured at reference 302 in any conventional fashion, such as glue, tack-stitch or continuous stitch. Where glue is employed, it is preferable that the glue is waterproof, so as not to decompose from the elements or from washing the scented hair accessory in a washing machine.

Once the longitudinal ends of material 302 are secured, material 202 is preferably inverted, both to hide the seam at reference 302, as well as to expose any pattern on the material. Alternatively, the seam at reference 302 may be exposed. The area enclosed within material 202 shall be referred to as a chamber.

Figure 4:
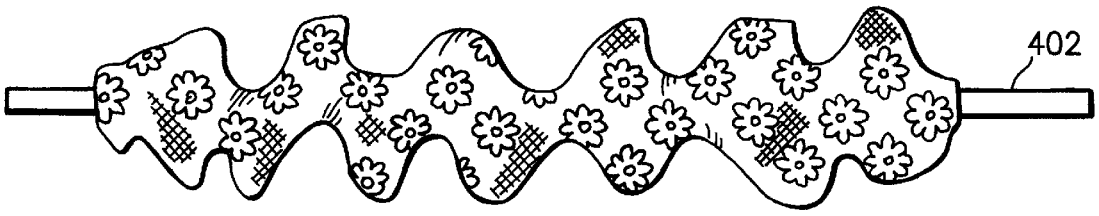
Figure 5:
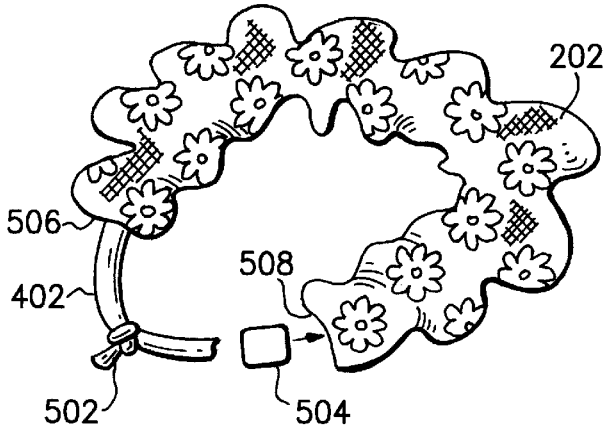

With reference to FIGS. 4 and 5, strand of elastic 402 is preferably inserted into the chamber of tubular housing 102 (FIG. 4), the ends of which are secured together, preferably via knot 502 (FIG. 5). The length of the elastic is preferably shorter than the length of the elastic, thereby providing a tubular housing which is resiliently expandable about inner circumferential area 104 (FIG. 1) of the tubular housing. When intended for use primarily in the user's hair, the length of the elastic strand is preferably ten (10) inches in length.

Alternatively, material 202 which forms tubular housing 102 can be elasticized fabric, thereby eliminating the necessity of elastic 402.

As shown in FIG. 5, scenting material 504 is preferably inserted into the chamber of material 202, and terminal ends 506 and 508 of the tubular housing are secured, preferably via thread. The scenting material can either have free movement within the chamber, or the scenting material can be affixed to a particular location, either on the elastic strand or on the tubular housing.

Scenting material 504 can have any type of aroma, and can comprise an absorbent pad having perfume absorbed therein, scented beads, a sachet of potpourri, or the like. Alternatively, a perfume or other aroma can be applied directly to the surface of tubular housing 102.

As an option to placing the scenting material within the chamber of the tubular housing, the tubular housing can comprise a pocket (FIG. 7) to locate the scenting material therewithin.

Figure 7:
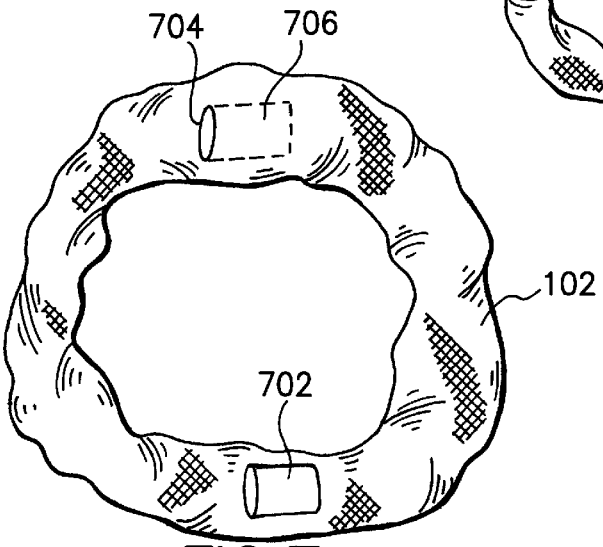
FIG. 7 is a top view of another embodiment of the hair accessory of the present invention.

With reference to FIG. 7, pocket 702 can be located on the surface of the tubular housing. Alternatively, slit 704 can be located in the tubular housing, with pocket 706 being located partially or fully therewithin.

The pocket (702 and/or 706) can be sealably accessible via a hook and rug arrangement such as VELCRO®, snap (s), button(s), zipper, clasp(s) or other conventional arrangement.

There are certain advantages to locating the scenting material in a user-accessible pocket. For example, the pocket allows a user to remove the scenting material when laundering the scented hair accessory. Additionally, the pocket allows the user to change the type and/or scent of the scenting material.

Figure 6:
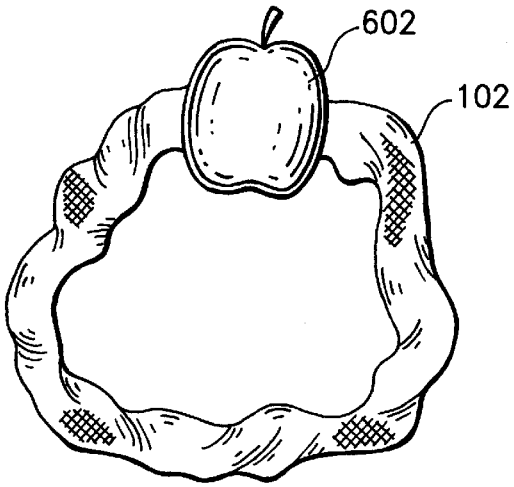
FIG. 6 is a top view of another preferred embodiment of the hair accessory of the present invention.

Turning now to FIG. 6, another preferred embodiment of the hair accessory of the present invention is illustrated. As shown in FIG. 6, ornamental structure 602 is located about a portion of tubular housing 102, preferably via placing tubular housing 102 through a chamber (not shown) which runs through the ornamental structure. Alternatively, terminal ends 506 and 508 (FIG. 5) of the tubular housing are affixed to the ornamental structure.

The ornamental structure preferably has a scent located on or embedded in the ornamental structure, and the scent is preferably associated with the shape or design thereof. For example, where ornamental structure 602 takes the shape of an apple, the scent thereof can be apple. Other ornamental structure shapes and/or scents, e.g., coconut, banana, lemon, lime, orange, strawberry, spice or chocolate, will be obvious to those in the art.

Scenting material 504 located within the chamber of tubular housing 102 can alternatively correspond to the pattern located on the tubular housing or to the scent of the ornamental structure. For example, spice or cinnamon scenting material can be used with an apple-shaped ornamental structure. Optionally, multiple scenting materials may be located within the chamber of the tubular housing or in the pocket attached thereto. Other scent combinations and/or design permutations will be obvious to those skilled in the art.

Although illustrative embodiments of the present invention have been described in detail with reference to the accompanying drawings, it is to be understood that the invention is not limited to those precise embodiments. Various changes or modifications may be effected therein by one skilled in the art without departing from the scope or spirit of the invention.

What I claim as my invention is:

1. A scented hair accessory device comprising:

a substantially tubular housing having a first and a second terminal end joined together to define an inner circumferential area, the entire length of the tubular housing consisting essentially of a substantially uniform cross-sectional diameter, the tubular housing being substantially flexible and resiliently expandable about the inner circumferential area; and scenting material located within the tubular housing, the scenting material having a scent emanating therefrom, wherein at least a portion of the tubular housing is porous, thereby allowing the scent emanating from the scenting material to escape therefrom.

2. The scented hair accessory device of claim 1, said device further comprising an elastic material located within the tubular housing to allow the tubular housing to be resiliently expandable about the inner circumferential area.

3. A scented hair accessory device comprising:

a substantially tubular housing having a first and a second terminal end joined together to define an inner circumferential area, the tubular housing being substantially flexible, wherein the tubular housing is resiliently expandable about the inner circumferential area and wherein the substantially entire length of the tubular housing essentially comprises a substantially uniform cross-sectional diameter;

a pocket operatively attached to a portion of the tubular housing; and scenting material located within the pocket, the scenting material having a scent emanating therefrom, wherein at least a portion of the pocket is porous, thereby allowing the scent emanating from the scenting material to escape therefrom.

4. The scented hair accessory device of claim 3, wherein said pocket is sealably accessible, thereby allowing a user to remove and/or replace the scenting material.

5. The scented hair accessory device of claim 3, said device further comprising:

a chamber located within the tubular housing.

6. The scented hair accessory device of claim 5, said device further comprising:

an elastic material located within the chamber to allow the tubular housing to be resiliently expandable about the inner circumferential area.

7. The scented hair accessory device of claim 5, said pocket comprising an enclosed portion and an open portion, and said tubular housing further comprising a slit therein, wherein:

at least a section of the enclosed portion of the pocket is located within the chamber of the tubular housing; and at least a section of the open portion of the pocket is accessible.

8. The scented hair accessory device of claim 7, wherein said open portion of the pocket is sealably accessible, thereby allowing a user to remove and/or replace the scenting material.

9. A hair accessory device comprising:

a substantially tubular housing consisting essentially of a first and a second terminal end joined together to define a single inner circumferential area, the entire length of the tubular housing having a substantially uniform cross-sectional diameter, the tubular housing being substantially flexible and resiliently expandable about the inner circumferential area;

an ornamental body operatively surrounding a portion of the tubular housing; and scenting operatively located on the ornamental body.

10. The hair accessory device of claim 9, said hair accessory further comprising:

a chamber located within the tubular housing; and scenting material located within the chamber of the tubular housing, the scenting material having a scent emanating therefrom, wherein at least a portion of the tubular housing is porous, thereby allowing the scent emanating from the scenting material to escape therefrom.

11. The hair accessory device of claim 9, said hair accessory further comprising:

a pocket operatively attached to a portion of the tubular housing; and scenting material located within the pocket, the scenting material having a scent emanating therefrom, wherein at least a portion of the pocket is porous, thereby allowing the scent emanating from the scenting material to escape therefrom.

12. The scented hair accessory device of claim 11, wherein said pocket is sealably accessible, thereby allowing a user to remove and/or replace the scenting material.

13. The scented hair accessory device of claim 11, said pocket comprising a sealed portion and an open portion, and said tubular housing further comprising a slit therein, wherein:

at least a section of the sealed portion of the pocket is located within the chamber of the tubular housing; and at least a section of the open portion of the pocket is accessible.

14. The scented hair accessory device of claim 13, wherein said pocket is sealably accessible, thereby allowing a user to remove and/or replace the scenting material.

15. The hair accessory device of claim 9, said device further comprising:

a chamber located within the tubular housing; and an elastic material located within the chamber to allow the tubular housing to be resiliently expandable about the inner circumferential area.

* * * * *